United States Patent [19]

Condie

[11] Patent Number: 4,571,896

[45] Date of Patent: Feb. 25, 1986

[54] GUTTER ASSEMBLY

[76] Inventor: Southam B. Condie, 4705 Gair Ave., Terrace, British Columbia, Canada, V8G 2J8

[21] Appl. No.: 603,716

[22] Filed: Apr. 25, 1984

[30] Foreign Application Priority Data

May 2, 1983 [CA] Canada ..... 427235

[51] Int. Cl.[4] ..... E04D 13/04

[52] U.S. Cl. ..... 52/12; 210/162; 210/801

[58] Field of Search ..... 52/11-16; 405/118-120, 127; 210/153, 154, 163, 155, 162, 474, 475, 498, 801

[56] References Cited

U.S. PATENT DOCUMENTS

| | | | |
|---|---|---|---|
| 603,611 | 5/1898 | Wye | 52/12 |
| 836,012 | 11/1906 | Cassen | 52/12 |
| 891,405 | 6/1908 | Cassens | 210/474 |
| 2,669,950 | 2/1954 | Bartholomew | 52/12 |
| 2,672,832 | 3/1954 | Goetz | 52/12 |
| 4,404,775 | 9/1983 | Demartini | 405/119 |
| 4,435,925 | 3/1984 | Jefferys | 52/12 |
| 4,497,146 | 2/1985 | Demartini | 52/12 |

*Primary Examiner*—John E. Murtagh

*Attorney, Agent, or Firm*—Beehler, Pavitt, Siegemund, Jagger & Martella

[57] ABSTRACT

A gutter assembly is provided which comprises an elongated, preferably transversely flexible sheet which when in an installed position extends along a building roof adjacent an edge of it, while extending below the roof edge. A pipe is provided which has a lengthwise extending slot which accommodates a side edge of the sheet through it adjacent an edge of the slot, while leaving room for entry of only water through the slot and into the pipe. A plurality of clips are dimensioned to be extendable outward from a surface of an edge strip of the sheet so that when the edge strip extends through the slot in the pipe, the clips can abut the inner surface of the pipe so as to retain an inside surface of the sheet against an edge of the slot. Preferably, the foregoing components are also dimensioned such that the sheet vertically supports the pipe. Such a gutter assembly inhibits entry of foreign matter into the pipe.

10 Claims, 5 Drawing Figures

24
25
5
4
2
22
3
6
12
18
20
26
14
16
16
10
28

25
24
5
4
2
22
3
6
12a
20a
26
18a
14a
16a
16a
10a
28

24
25
5
22
4
2
3
29
12b
6
26
14b
20b
18b
29
10b
30

GUTTER ASSEMBLY

This invention relates to a gutter assembly which particularly inhibits foreign articles entering the gutter.

Gutters which utilize an elongated sheet with a first side edge strip extending along the edge of a building roof, and a second side edge strip extending below the roof edge and inward of it, are well-known. In such gutters, the sheet serves to conduct water from the roof downwardly and inwardly by virtue of surface tension, while leaves and other foreign material will tend not to adhere to the second side edge strip of the sheet and will be washed off it. Such gutters are disclosed in U.S. Pat. Nos. 603,611 to Nye and 2,669,950 to Bartholomew. Gutters are also known which utilize a sheet of the foregoing description with a downwardly extending second side edge strip, or a downwardly and inwardly extending second side edge strip, in conjunction with a gutter having a lengthwise extending slot through which the second side edge strip is accommodated. Such gutters are designed on the principle that water will again tend to be conducted over the sheet and into the gutter as a result of surface tension, while foreign matter is excluded from the gutter either as a result of the inward extension of the second side edge strip, or the foregoing in combination with the narrow slot. Such gutters are disclosed in U.S. Pat. Nos. 2,120,395 to Dean, 406,233 to Phelps, 1,313,742 to Schad, 546,042 to Van Horn, 836,012 to Cassen, 891,405 to Cassens, and 2,672,832 to Goetz.

A difficulty with the foregoing types of gutters not utilizing a narrow slot, is that foreign material could still enter the gutter. With those gutters utilizing a narrow slot in conjunction with a surface to conduct water into the slot, problems might include manufacturing tolerances which must be maintained, and avoidance of any even minor damage during installation. As such gutters were typically made of metal, such damage could readily occur during installation and thereby lead to a widening of portions of the slot in the gutter and consequent entry of foreign material, or a narrowing of such portions resulting in water overflow from those portions of the gutter. In addition, as such previous gutters are typically of relatively complex construction, their weight is increased over conventional gutters thereby making for more difficult installation. Such gutters also typically must be secured in place in the same manner as conventional gutters and the surface for conducting the water into the gutter normally must be already transversely bent during manufacturing so that a first side edge strip of such surface can extend flushly along a building roof adjacent an edge of it.

It is desirable then to provide a gutter assembly which provides a sheet to conduct water from the roof of a building by surface tension into a pipe having an elongated slot of a width sufficient to permit entry of only water, and which gutter assembly is of relatively simple construction, is easily installed, and in which the sheet is readily maintained in proper relation to the slot in the pipe.

A gutter assembly is provided which comprises an elongated sheet dimensioned so that when it is in an installed position, the first side edge strip of the sheet can extend along a building roof adjacent an edge of it, while a second side edge strip of the sheet extends below the roof edge. A pipe is provided which has a lengthwise extending slot in it. The slot is of sufficient width so as to accommodate the second side edge strip of the elongated sheet therethrough adjacent an edge of the slot, while leaving room for entry of only water through the slot and into the pipe. The gutter assembly also comprises a plurality of clips dimensioned to be extendable outward from a surface of the second edge strip so that when the second edge strip extends through the slot in the pipe, the clips can abut the inner surface of the pipe so as to retain an inside surface of the sheet against an edge of the slot.

Preferably, the sheet is transversely flexible, and the clips can abut the inner surface of the pipe while being slidable therealong.

Usefully, the clips are extendable outward from both surfaces of the second edge strip. The pipe and the clips are dimensioned so that when the sheet is in the installed position and the second edge strip extends through the slot in the pipe, the clips can abut opposed portions of the inner surface of the pipe and retain an inside surface of the sheet against an edge of the slot while vertically supporting the pipe.

Usefully, the sheet has a plurality of holes through the second edge strip of it to accommodate respective ones of the clips through the holes. Each of the clips can usefully comprise a rod with a substantially V-shaped kink between the ends thereof.

The apex of the V-shaped in each of the rods is preferably disposed a distance from an end of the rod substantially equal to one half the length of the rod plus one half the width of the slot in the pipe.

Each of the rods usefully has ends transversely curving away from the apex of the kink.

Of the various possible shapes of the pipe, in one embodiment the pipe is usefully circular in transverse cross section with a uniform inside diameter which is substantially equal to the length of the clips. In another embodiment, the pipe is usefully rectangular in transverse cross section, with a uniform length of the hypotenuse which is substantially equal to the length of the clips.

A gutter assembly comprising the foregoing elements assembled is also provided.

Embodiments of the invention will now be described in detail with reference to the drawings in which.

Figure 1:
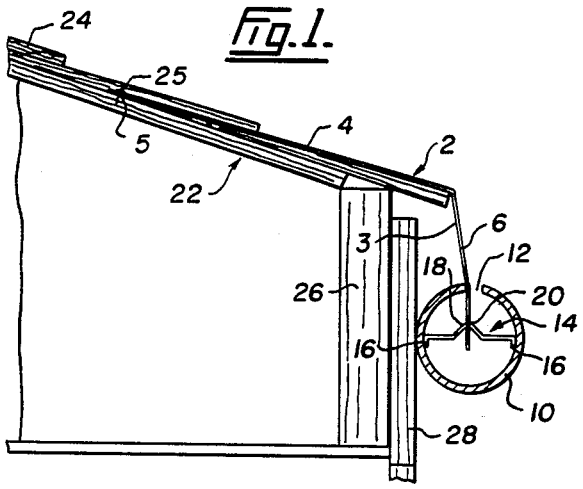
FIG. 1 is a transverse cross section of a gutter assembly of the present invention installed on a building roof.
Figure 3:
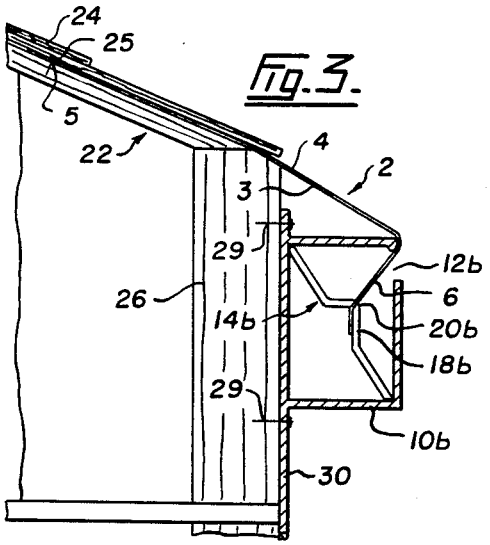
FIG. 3 is a view similar to FIGS. 1 and 2 but showing a further embodiment of the present invention.
Figure 4:
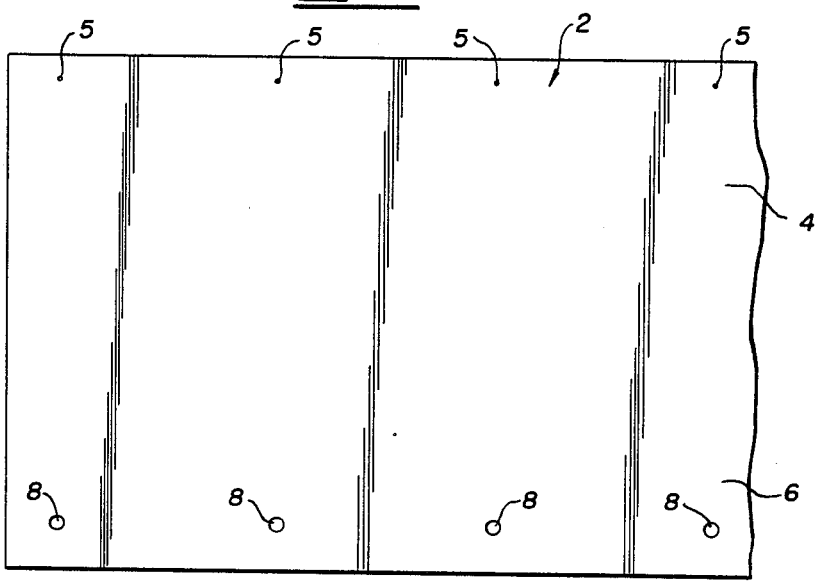
FIG. 4 is a top view of a flexible sheet utilized in the gutter assemblies shown in FIGS. 1 through 3.

Referring first to FIG. 1, a gutter assembly is shown which utilizes an elongated transversely flexible sheet 2 which prior to installation can be flat as shown in FIG. 4, or rolled up, as desired. As shown installed in FIG. 1, transversely flexible sheet 2 has a first side edge strip 4 extending along a building roof 22 (which includes shingles 24) adjacent an edge of the roof. The first side edge strip 4 is fastened to the roof 22 by means of nails 25 passing through the first side edge strip 4 at positions 5. As sheet 2 is normally made of plastic, nails 25 should preferably be washer nails to prevent cracking of sheet 2. The sheet 2 has a second side edge strip 6 with a plurality of holes 8 disposed therealong as shown most clearly in FIG. 4. In the installed position shown in FIGS. 1 to 3, the second side edge strip 6 extends below the roof edge. It will be noted that the sheet 2 is preferably of sufficient strength as to be able to vertically support a pipe 10 in the manner to be described.

The pipe 10 shown in FIG. 1, has a circular transverse cross section of uniform diameter, and is provided with an elongated slot 12 extending along an upper side of the pipe 10. The slot 12 accommodates the second edge strip 6 of the sheet 2 through it and adjacent an inner edge of the slot 12 as shown most clearly in FIG. 1, while leaving sufficient room for entry of only water through the slot 12 and into the pipe 10. The pipe 10 itself when installed, normally abuts a fascia board 28 attached to the side 26 of the building.

Figure 5:
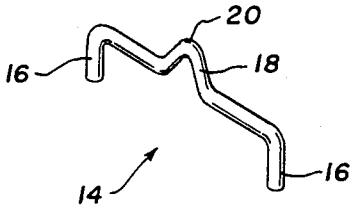
FIG. 5 is a perspective view of the rods utilized in the gutter assembly shown in FIGS. 1 and 2.

A plurality of clips in the form of rods 14 are provided which extend outward from both surfaces of the second edge strip 6. Clips 14 as shown most clearly in FIG. 5, have an inverted V-shaped kink 18 therealong, with downcurving ends 16. Each rod 14 is equal in length to the inside diameter of the pipe 10, with the apex 20 of each rod 14 being positioned from an edge of the rod 14 a distance equal to one half the length of the rod 14 plus one half the width of the slot 12. When the gutter assembly is installed in the manner shown in FIG. 1, rods 14 extend through respective holes 8 in the second edge strip 6 of sheet 4, with apeces 20 of the kinks 18 being positioned in respect of holes 8, and with downcurving ends 16 abutting the inside surface of the pipe 10.

Figure 2:
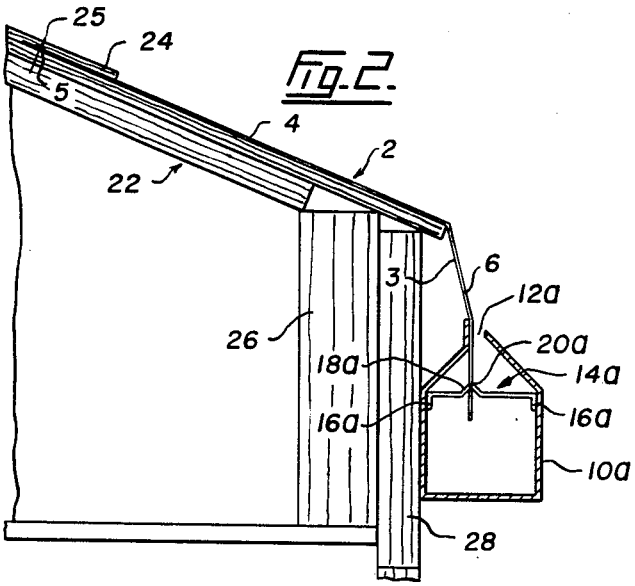
FIG. 2 is a view similar to FIG. 1 showing another embodiment of the gutter assembly of the present invention.

The gutter assembly shown in FIG. 2 is basically the same in construction as that shown in FIG. 1, with the exception that pipe 10*a* has a transverse cross section of the shape shown in FIG. 2. The pipe 10*a* is also provided with a slot 12*a* while the assembly is provided with rods 14*a*. It will be appreciated that rods 14*a* are not the same dimensions as rods 14 in FIG. 1, since the pipe 10*a* has a greater width than the diameter of pipe 10, and may also have a different width of the slot 12*a*. Accordingly, the length of rods 14*a* must be altered so that downcurved end 16 thereof will abut the inside surface of pipe 10*a*. Apeces 20*a* though will still be positioned from an end of respective rods 14*a* a distance equal to one half the length of rods 14*a* plus one half the width of slot 12*a*, as slot 12*a* is still positioned in the middle of an upper side of the pipe 10*a*. The embodiment of the gutter assembly shown in FIG. 3 is again basically the same as that in FIGS. 1 and 2 with analogous parts being numbered the same or with a b postscript. In the embodiment of FIG. 3, the pipe 10*b* has a rectangular transverse cross section with a uniform length of the hypotenuse which is equal to the length of the clips 14*b*. The pipe 10*b* is also provided with a sheet 30 which replaces the fascia board 28 in FIGS. 1 and 2, and which is nailed to the wall 26 by means of nails 29 (which again should preferably be washer nails where the pipe 10*b* is made from plastic). The rods 14*b* do not have downcurved ends in the embodiment of the gutter assembly in FIG. 3, since the ends of rods 14*b* abut opposing corners of the inside of the pipe 10*b* in the manner shown in FIG. 3. The apex 20*b* of each V-shaped kink 18*b* preferably is positioned relative to the one end of its rod 14*b* as previously described.

To install any of the gutter assemblies shown in FIGS. 1 to 3, the first side edge strip 2 of sheet 4 is nailed to the roof 22 and the second side edge strip 6 bent over the edge of the roof 22 to extend downwardly and below the roof edge. An end of respective pipes 10, 10*a*, or 10*b* can be positioned adjacent an end of the second side edge strip 6 of the sheet 2 and the pipe then slid longitudinally so that the second side edge 6 slides into respective slots 12, 12*a*, or 12*b*. As the pipe is slid, immediately before each hole 8 on the second side edge strip 6 enters the pipe, a clip 14, 14*a*, or 14*b* can be positioned through such holes so that it will enter the pipe along with that hole and slide along the inside surface of the pipe as it is slid into position. Alternatively, the pipe can be held in position adjacent the fascia board 28 (or in the case of the embodiment in FIG. 3, the wall 26), and the second side edge 6 of the flexible sheet slid into the pipe with clips being placed through each hole 8 in a similar manner as previously described, followed by nailing of the first side edge 4 of the sheet 2 to the roof 22. In the case of the embodiment of FIG. 3, the sheet 30 will also be nailed into place by nails 29.

When the gutter assemblies are installed in the foregoing manner, it will be noted that in each case clips 14, 14*a*, or 14*b* abut the inside surface of respective pipes so as to retain the inside surface 3 of the sheet 2 against an inner edge of respective slots 12, 12*a*, or 12*b*. Thus, in such manner the predetermined space required in the slots for entry of water but not foreign matter, is readily maintained while at the same time the gutter assembly is readily assembled. In addition, in the case of the embodiments of FIGS. 1 and 2 the pipe is also suspended from the flexible sheet 2 (and in the case of the embodiment of FIG. 3 additional support is provided thereby), thereby eliminating the need for a great number of pins to connect the pipe to the fascia board 28 or wall 26 which are utilized in conventional gutters. However, one or two of such pins or brackets may be required to prevent outward movement of the pipe during high winds or the like. During rain, water will tend to run down the sheet 2 and adhere to the second side edge strip 4 by means of surface tension, thereby be directed through the slot 12, 12*a*, or 12*b* into the pipe. However, foreign matter will be inhibited from entering the pipe as in many cases it will be unable to adhere to the second side edge strip 6 of sheet 2 nor because of its size, enter the slot 12, 12*a*, or 12*b*. In particular, the embodiment shown in FIG. 3 due to the manner in which the second side edge 6 of the sheet 2 slopes inward and downward, will be particularly effective in eliminating foreign matter which may wash down the outer surface 5 of sheet 2 from the roof.

Variations to the gutter assembly suscribed are of course possible. For example, pipes with other shapes of transverse cross section may be utilized with corresponding changes in the dimensions of the clips or rods. As will be apparent to those skilled in the art in light of the foregoing disclosure, many other alterations and modifications are possible in the practice of this invention without departing from the spirit or scope of it. Accordingly, the scope of the invention is to be construed in accordance with the substance defined by the following claims.

I claim:

1. A gutter assembly comprising:

(a) an elongated sheet to be installed along an edge of a roof of a building with a part of said sheet extending below the roof edge, said part having an inner surface adjacent the building and an outer surface;

(b) a pipe having a longitudinal slot therein to receive said part of said sheet that extends below the roof edge while leaving room for entry of only water through the slot and into said pipe; and (c) a plurality of clips extending, from a surface of said part of said sheet to abut the interior of said pipe to retain the inner surface of said part of said sheet against an edge of the slot.

2. A gutter assembly as defined in claim 1 wherein said sheet is transversely flexible, and wherein said clips can abut and slide along the interior of said pipe.

3. A gutter assembly as defined in claim 1 wherein said clips extend from both surfaces of said part of said sheet so that said clips can abut opposed portions of the interior of said pipe to retain the inner surface of said part of said sheet against an edge of the slot and also vertically support said pipe.

4. A gutter assembly as defined in claim 2 wherein said clips extend from both surfaces of said part of said sheet so that said clips can abut opposed portions of the interior of said pipe to retain the inner surface of said part of said sheet against an edge of the slot and also vertically support said pipe.

5. A gutter assembly as defined in claim 4 wherein said part of said sheet has a plurality of holes, each hole to accommodate a clip, and wherein each of said clips comprises a rod with a substantially V-shaped kink between its ends.

6. A gutter assembly as defined in claim 5 wherein the apex of the V-shaped kink in each of said rods is disposed a distance from an end thereof substantially equal to one half the length of the rod plus one-half the width of the slot in said pipe.

7. A gutter assembly as described in claim 6 wherein each of said rods has ends transversely curving away from the apex of the kink.

8. A gutter assembly as described in claim 6 wherein said pipe is circular in transverse cross section with a uniform inside diameter which is substantially equal to the length of said clips.

9. A gutter assembly as described in claim 7 wherein said pipe is circular in transverse cross section with a uniform inside diameter which is substantially equal to the length of said clips.

10. A gutter assembly as defined in claim 6 wherein said pipe is rectangular in transverse cross section with a uniform length of the hypotenuse which is substantially equal to the length of said clips.

* * * * *